US006226354B1

(12) United States Patent
Mamine

(10) Patent No.: US 6,226,354 B1
(45) Date of Patent: May 1, 2001

(54) SHORT-WAVELENGTH ELECTROMAGNETIC-RADIATION GENERATOR

(75) Inventor: Takayoshi Mamine, Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/195,103

(22) Filed: Nov. 18, 1998

(30) Foreign Application Priority Data

Nov. 21, 1997 (JP) ..... 9-320762
Mar. 23, 1998 (JP) ..... 10-073649

(51) Int. Cl.[7] ..... G21G 4/00
(52) U.S. Cl. ..... 378/119; 378/121
(58) Field of Search ..... 378/119, 121

(56) References Cited

U.S. PATENT DOCUMENTS 4,456,812 * 6/1984 Neiheisel et al. .
4,598,415 * 7/1986 Luccio et al. ..... 378/119
5,247,562 * 9/1993 Steinbach ..... 378/119
5,539,764 * 7/1996 Shields et al. .

* cited by examiner

*Primary Examiner*—David V. Bruce
*Assistant Examiner*—Pamela R. Hobden
(74) *Attorney, Agent, or Firm*—Ronald P. Kananen; Rader, Fishman & Grauer

(57) ABSTRACT

A short-wavelength electromagnetic-radiation generator includes a pair of concave reflectors, a laser source for emitting a laser beam so as to be incident between the concave reflectors, and an electron beam generator for emitting an electron beam so as to be incident on the laser beam, which is repeatedly reflected and converged.

8 Claims, 5 Drawing Sheets

SHORT-WAVELENGTH ELECTROMAGNETIC-RADIATION GENERATOR

BACKGROUND OF THE INVENTION

1. Field of the Invention

The present invention relates to short-wavelength electromagnetic-radiation generators that generate electromagnetic radiation having short wavelengths by causing photons and electrons to collide.

2. Description of the Related Art

In lithography applied to the production of semiconductor devices, a base is formed and patterned by performing predetermined exposure of a resist, developing the exposed resist, and etching the developed resist.

Recently, with refinement of design rules, it is necessary to use photolithography using a short-wavelength electromagnetic-radiation source. A KrF excimer laser (whose wavelength is 248 nm), an ArF excimer laser (whose wavelength is 193 nm), etc., are used as the short-wavelength electromagnetic-radiation source.

For obtaining short-wavelength electromagnetic radiation, electron-beam lithography, and X-ray-beam lithography to which synchrotron radiation is applied, are under consideration.

The electron-beam lithography is suitable for limited production of a wide variety of goods, but is not suitable for mass production due to its low throughput. The X-ray-beam lithography to which synchrotron radiation is applied requires a large, complicated apparatus as an X-ray source, which disadvantageously increases cost in production of semiconductor devices.

Accordingly, a method is being researched utilizing the inverse Compton effect as a technique which will allow a small apparatus to be used to yield short-wavelength exposure electromagnetic radiation. An electromagnetic radiation source which utilizes the inverse Compton effect uses electromagnetic-radiation scattering caused by electrons moving at a relativistic velocity, to supply photons with the energy of the electrons, whereby shortening the wavelength of the scattered electromagnetic radiation.

In the inverse Compton effect, a problem occurs in that the yield of obtained photons in X-ray regions is small because a scattering cross section based on the electrons and the photons is an extremely small value of $10^{-27}$ $cm^2$. Therefore, in lithography, sufficient X-ray energy cannot be produced, which is a likely problem in practice.

SUMMARY OF THE INVENTION

Accordingly, it is an object of the present invention to provide a short-wavelength electromagnetic-radiation generator capable of generating sufficient X-ray energy for lithography.

To this end, according to an aspect of the present invention, the foregoing object has been achieved through provision of a short-wavelength electromagnetic-radiation generator including: reflector means composed of at least a pair of concave reflectors; emitting means for emitting electromagnetic radiation so as to be incident on the reflector means; and electron-beam generating means for emitting an electron beam so as to be incident on the electromagnetic radiation, which is repeatedly reflected and converged.

According to another aspect of the present invention, the foregoing object has been achieved through provision of a short-wavelength electromagnetic-radiation generator including: reflector means composed of at least a pair of concave reflectors; electron-beam generating means for emitting an electron beam having a diameter adjusted to the diameter of electromagnetic radiation converged by at least a pair of concave reflectors in the reflector means so that the electron beam is incident on a region where the electromagnetic radiation is converged by the pair of concave reflectors; and emitting means for emitting a pulse beam having a pulse width corresponding to the diameter of the electron beam so as to be incident on the reflector means.

Preferably, the reflector means comprises concave reflector groups disposed to be opposed, each concave reflector group being composed of a plurality of aligned concave reflectors The emitting means may comprise a Q-switched laser source, a mode-locked laser source, a Q-switched laser source, or a mode locked laser source.

According to the present invention, in a small short-wavelength electromagnetic-radiation generator, an electron beam is emitted to be incident on electromagnetic radiation being repeatedly reflected and converged by reflectors, whereby the electron beam and the electromagnetic radiation can collide successively. Thus, high scattering frequency can greatly increase the yield of scattered electromagnetic radiation. This makes it possible to apply the present invention to lithography in the production of semiconductor devices.

DESCRIPTION OF THE PREFERRED EMBODIMENTS

Short-wavelength electromagnetic-radiation generators according to embodiments of the present invention will be described below with reference to the attached drawings.

Figure 1:
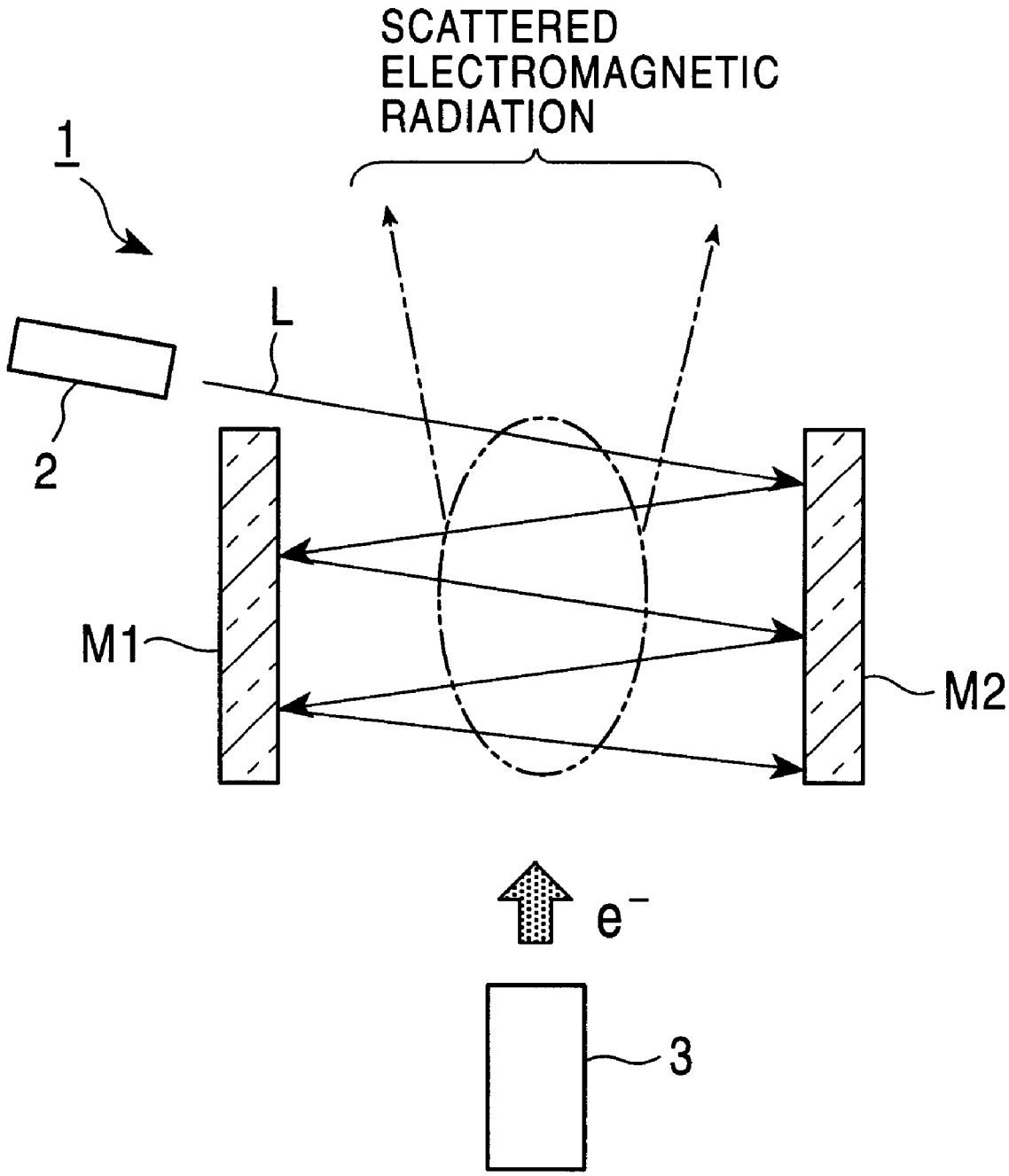
FIG. 1 is a schematic section view illustrating the fundamental principles of the present invention.

Referring to FIG. 1, the fundamental principles of the present invention are described. A short-wavelength electromagnetic-radiation generator 1 includes a pair of reflectors M1 and M2 disposed approximately in parallel, a laser source 2 for emitting an electromagnetic radiation beam (hereinafter referred to as "laser beam L") having a predetermined wavelength so as to be incident between the reflectors M1 and M2, and an electron beam generator 3 for emitting an electron beam $e^-$ with respect to the laser beam L, which is repeatedly reflected between the reflectors M1 and M2.

Concerning the reflectors M1 and M2, reflectors having a reflectance of, e.g., 99.90% to 99.99%, may be used. Concerning the laser source 2, continuous-wave (CW) gas lasers, and Q-switched lasers capable of emitting a highly-efficient, high-output, short-pulse-width laser beam, may be used. Lasers of these types include, for example, solid-state lasers such as yttrium-aluminum-garnet (YAG) lasers and titanium-sapphire lasers, and gas lasers such as carbon dioxide lasers, XeCl excimer lasers, KrF excimer lasers, and ArF excimer lasers.

The electron beam generator 3 is designed to emit an electron beam $e^-$, which is pulse-shaped.

In order that scattered electromagnetic radiation may be generated using the short-wavelength electromagnetic-radiation generator 1, initially, the laser beam L is emitted from the laser source 2 so as to be incident between the reflectors M1 and M2. The laser beam L is repeatedly reflected by the reflectors M1 and M2.

Next, the electron beam $e^-$ is emitted from the electron beam generator 3 so as to collide with the laser beam L being repeatedly reflected between the reflectors M1 and M2. At this time, it is preferable that, for the electron beam $e^-$, its relativistic electron voltage, namely, its acceleration voltage be 100 keV or greater, and its speed be approximately 0.5×c or greater (where c represents the electromagnetic constant).

Thereby, the electron beam $e^-$ emitted from the electron beam generator 3 collides at high frequency with the laser beam L being repeatedly reflected between the reflectors M1 and M2, which generates the inverse Compton effect in the scattering region S indicated by the double-dotted chain line shown in FIG. 1.

As a result, in the scattering region S, the energy of the electron beam e is supplied to the photons of the laser beam L, whereby scattered electromagnetic radiation that has a wavelength shorter than that of the laser beam L when it is incident between the reflectors M1 and M2 can be generated at a high yield.

Figure 2:
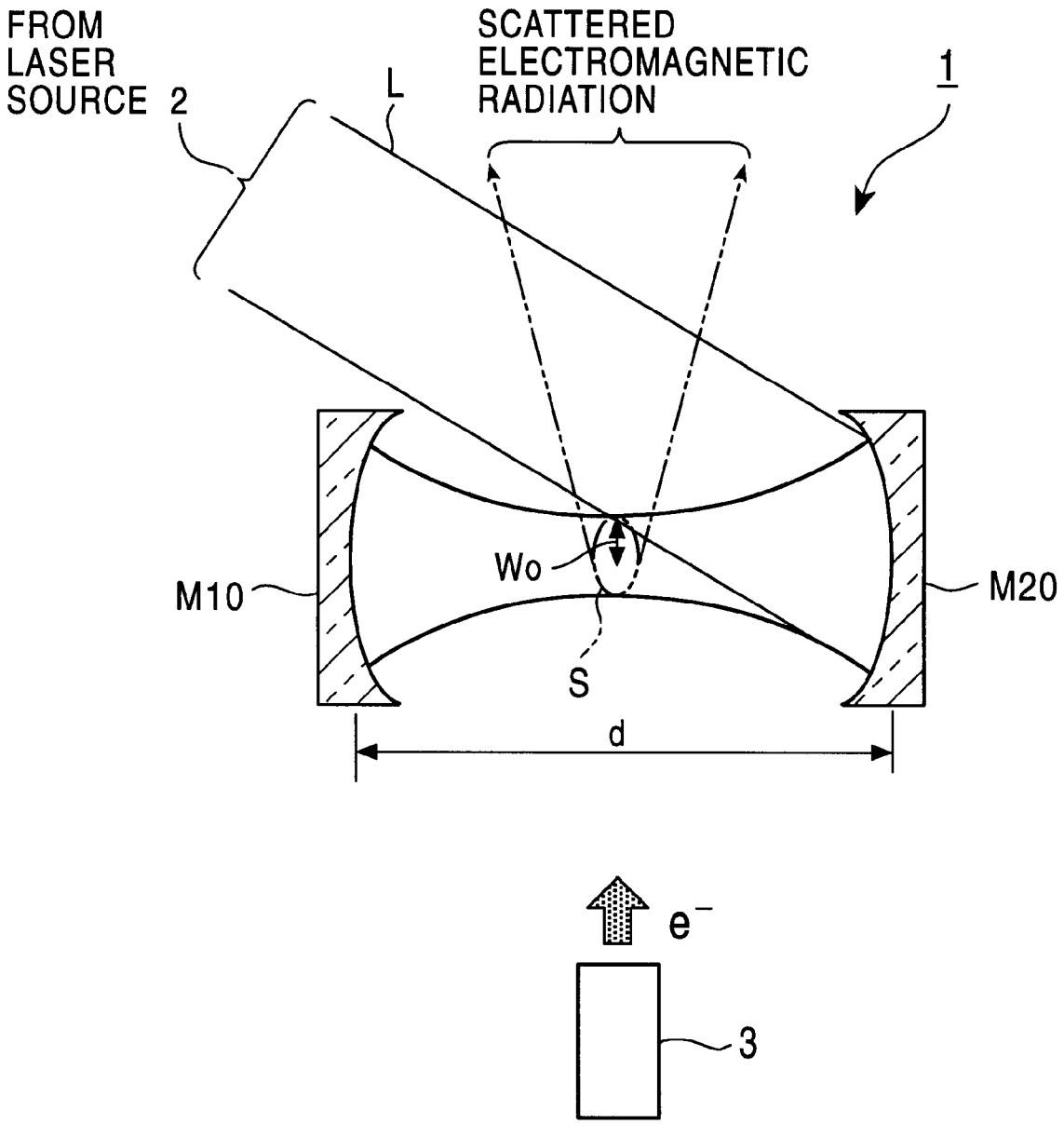
FIG. 2 is a schematic section view illustrating a short-wavelength electromagnetic-radiation generator according to a first embodiment of the present invention.

An embodiment of the present invention will be described below in which the above-described fundamental principles are developed to increase frequency of scattering. FIG. 2 shows a schematic section view of a first embodiment of the present invention. A short-wavelength electromagnetic-radiation generator 1 according to the first embodiment of the present invention includes a pair of concave reflectors M10 and M20 disposed approximately in parallel, a laser source 2 for emitting an electromagnetic radiation beam (laser beam L) having a predetermined wavelength so as to be incident between the concave reflectors M10 and M20, and an electron beam generator 3 for emitting an electron beam $e^-$ with respect to the laser beam L, which is repeatedly reflected between the concave reflectors M10 and M20.

Concerning the concave reflectors M10 and M20, concave reflectors having a reflectance of, e.g., 99.90% to 99.99%, may be used. Concerning the laser source 2 and the electron beam generator 3, ones similar in structure to those described in the fundamental principles may be used.

In order that scattered electromagnetic radiation may be generated using the short-wavelength electromagnetic-radiation generator 1, initially, the laser beam L is emitted from the laser source 2 so as to be incident between the concave reflectors M10 and M20. Between the concave reflectors M10 and M20, the laser beam L converges in accordance with a radius of curvature thereof, and is repeatedly reflected.

Next, the electron beam $e^-$ is emitted from the electron beam generator 3 so as to collide with the laser beam L converging and being repeatedly reflected between the concave reflectors M10 and M20. At this time, it is preferable, for the electron beam $e^-$, that its relativistic electron voltage, namely, its acceleration voltage be 100 keV or greater, and its speed be approximately 0.5×c or greater (where c is the electromagnetic constant).

Thereby, the electron beam $e^-$ emitted from the electron beam generator 3 collides at high frequency with the laser beam L converging and being repeatedly reflected between the concave reflectors M10 and M20. In other words, because the laser beam L converges and is repeatedly reflected between the concave reflectors M10 and M20, its photon density increases greatly at the convergence point. Accordingly, by emitting the electron beam $e^-$ where the laser beam L converges, the inverse Compton effect is generated at an extremely high frequency in the scattering region S indicated by the double-dotted chain line shown in FIG. 2.

As a result, in the scattering region S, the energy of the electron beam $e^-$ is supplied to the photons of the laser beam L, whereby scattered electromagnetic radiation having a wavelength shorter than that of the laser beam L when it is incident between the reflectors M1 and M2 can be generated at a high yield.

When the distance between the concave reflectors M10 and M20 is represented by d, a radius of curvature is represented by r (the concave reflectors M10 and M20 have the same radius of curvature), and the beam radius of a beam waist is represented by $w_0$, among distance d, radius of curvature r, and beam radius $w_0$, the following relationship holds.

$$W_0=(\lambda/\pi)^{1/2}\cdot(d/2)^{1/4}\cdot(r-(d/2))^{1/4}$$

It is more preferable that beam radius $w_0$ be as small as possible. However, the need for avoiding a loss due to beam shaping, etc., limits beam radius $w_0$ to approximately 25 $\mu$m as a beam radius for enabling actual convergence.

Although radius of curvature r must be set at some positive value, large r requires distance d in the above equation to be highly precise. By way of example, when r=3 cm, distance d for realizing radius $w_0$=25 $\mu$m is 5.977 cm.

Reflectance R of each of the concave reflectors M10 and M20 is 99.90% to 99.99%. When the laser beam L is repeatedly reflected between the concave reflectors M10 and M20, its intensity I is expressed by the following equation, ignoring transmission loss.

$$I=(1/(1-R))\cdot I_0\approx 100 \text{ to } 1000\times I_0$$

where $I_0$ represents the intensity of incident electromagnetic radiation.

The diameter of the laser beam L in the scattering region S is always expressed as $\pi w_0^2$. Thus, photon yield Y obtained by the collision of a single electron and photons is 100 to 1000 times greater than that obtained when an electron collides with only an incident beam. Photon yield Y is expressed by the following equation:

$$Y=(2N_e:N_p\cdot\sigma\cdot L)/(A\cdot\tau\cdot c)$$

where $N_e$ represents the number of electrons in an electron beam;

$N_p$ represents the number of photons in a laser beam;

$\sigma$ represents the area of a basic scattering cross section, which is $(8/3)\pi(e/mc^2)^2$ $cm^2$;

L represents an effective distance in the region where an electron beam and a laser beam collide;

A represents the area (in units of $cm^2$) of a larger cross section among the cross sections of an electron beam and a laser beam (In the case where A varies in the region where an electron beam and a laser beam collide, the maximum is used as A);

$\tau$ represents the width (in units of seconds) of longer pulses among the pulses of an electron beam and a laser beam that collide; and c represents the electromagnetic constant ($3\times10^{10}$ cm/second).

In other words, by causing the electron beam $e^-$ to be incident on the laser beam L converging and being repeatedly reflected between the concave reflectors M10 and M20, scattered electromagnetic radiation can be generated at a yield 100 to 1000 times greater than that obtained when the electron beam $e^-$ collides with only incident electromagnetic radiation.

Figure 3:
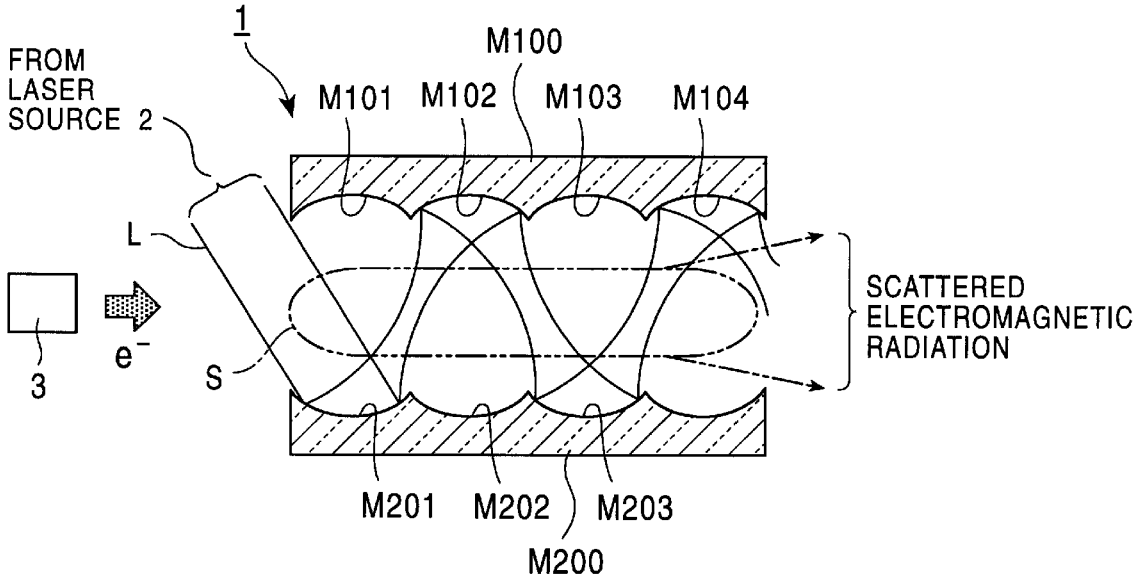
FIG. 3 is a schematic section view illustrating a short-wavelength electromagnetic-radiation generator according to a second embodiment of the present invention.
Figure 4:
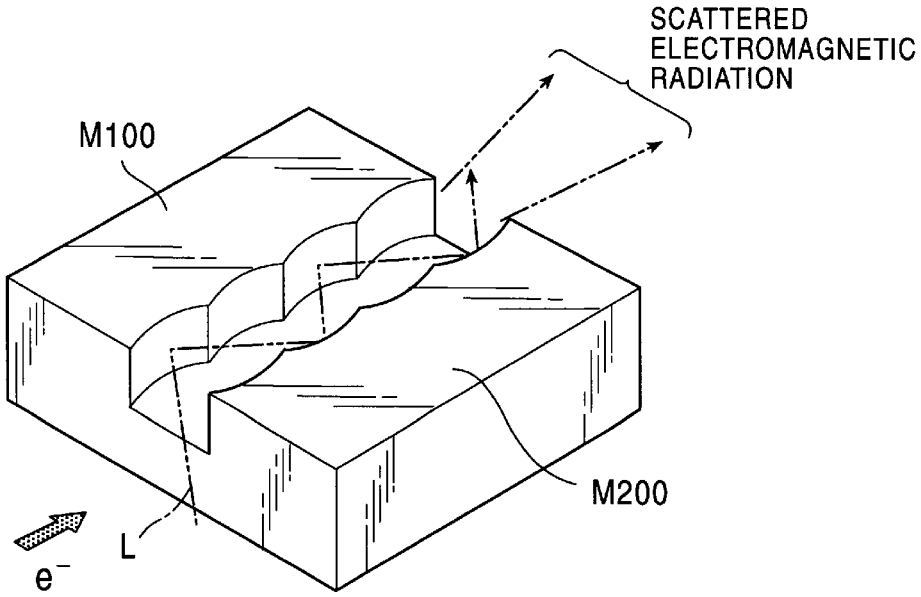
FIG. 4 is a schematic perspective view illustrating a short-wavelength electromagnetic-radiation generator according to a second embodiment of the present invention.

Next, a short-wavelength electromagnetic-radiation generator 1 according to a second embodiment of the present invention will be described with reference to FIGS. 3 and 4. FIG. 3 shows a schematic cross section view of the short-wavelength electromagnetic-radiation generator 1 according to the second embodiment. FIG. 4 shows a perspective schematic view of the short-wavelength electromagnetic-radiation generator 1 according to the second embodiment. In FIGS. 3 and 4, the shape of concave reflectors, the shape and path of a reflected beam, etc., indicate their concepts.

The short-wavelength electromagnetic-radiation generator 1 according to the second embodiment includes concave reflector groups M100 and M200 disposed to be opposed, a laser source 2 for emitting an electromagnetic radiation beam (laser beam L) having a predetermined wavelength so as to be incident between the concave reflector groups M100 and M200, and an electron beam generator 3 for emitting an electron beam $e^-$ with respect to the laser beam L, which is being repeatedly reflected between the concave reflector groups M100 and M200.

The concave reflector group M100 consists of a plurality of aligned concave reflectors M101 to M104. The concave reflector group M200 consists of a plurality of aligned concave reflectors M201 to M204. In other words, with the concave reflector groups M100 and M200 disposed to be opposed, the concave reflectors M101 to M104 are opposed to the concave reflectors M201 to M204, respectively.

For producing the opposed concave reflector groups M100 and M200, for example, concave reflectors may simply be arranged in an array, or a monolithic arrangement may be used by forming, on a base member made of an insulator such as semiconductor or metal, a groove for the respective concave reflectors M101 to M104 and M201 to M204, and coating two sides of the groove with metal or the like.

Concerning the laser source 2 and the electron beam generator 3, devices similar to those described in the fundamental principles may be used.

In order that scattered electromagnetic radiation may be generated by the short-wavelength electromagnetic-radiation generator 1, initially, the laser beam L is emitted from the laser source 2 so as to be incident between the concave reflector groups M100 and M200. The laser beam L is reflected and converged by the concave reflector M201 (or the M101) of one concave reflector group M200 (or M100), and is reflected by the concave reflector M102 (or M201) of the other concave reflector group M100 (or M200).

The laser beam L, reflected by the concave reflector M102 (or M202), is converged and reflected by the concave reflector M203 (or M103) of one concave reflector group M200 (or M100), and is reflected by the concave reflector M104 (or M204) of the other concave reflector group M100 (or M200).

In other words, the laser beam L, emitted from the laser source 2, is repeatedly reflected and converged zigzag between the concave reflector groups M100 and M200.

Next, the electron beam $e^-$ is emitted by the electron beam generator 3 between the concave reflector groups M100 and M200 so as to collide with the laser beam L, which is being repeatedly reflected and converged between the concave reflector groups M100 and M200.

It is preferable that, for the electron beam $e^-$, its relativistic electron voltage, namely, its acceleration voltage be 100 keV or greater, and its speed be approximately 0.5×c or greater (where c represents the electromagnetic constant).

The electron beam $e^-$, emitted from the electron beam generator 3, collides at an extremely high frequency with the laser beam L, which is being repeatedly reflected and converged between the concave reflector groups M100 and M200. In other words, because the laser beam L is repeatedly reflected and converged between the concave reflector groups M100 and M200, a photon density obtained where the laser beam L is converged is extremely increased. Accordingly, by emitting the electron beam e where the laser beam L converges, the inverse Compton effect is generated at an extremely high frequency in the scattering region S indicated by the double-dotted chain line shown in FIG. 3.

As a result, in the scattering region S, the energy of the electron beam $e^-$ is supplied to the photons of the laser beam L, whereby scattered electromagnetic radiation that has a wavelength shorter than that of the laser beam L when it is incident between the concave reflector groups M100 and M200 can be generated at a high yield.

In the second embodiment, the concave reflector group M100 consists of the four concave reflectors M101 to M104, and the concave reflector group M200 consists of the four concave reflectors M201 to M204. However, the number of concave reflectors constituting the concave reflector group M100 or M200 is not limited to four.

Figure 5:
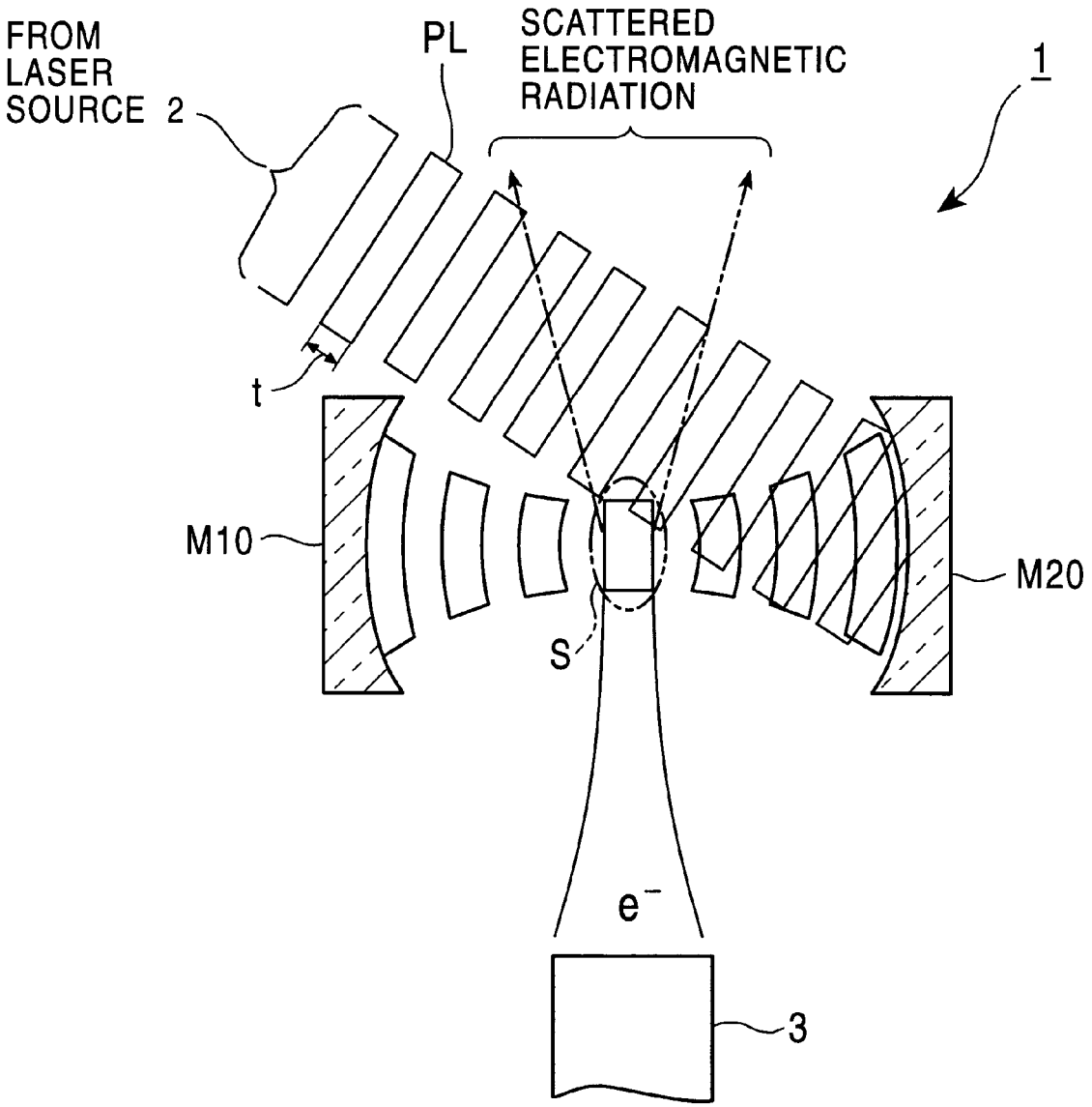
FIG. 5 is a schematic section view illustrating a short-wavelength electromagnetic-radiation generator according to a third embodiment of the present invention.

A short-wavelength electromagnetic-radiation generator 1 according to a third embodiment of the present invention will be described below with reference to FIG. 5. FIG. 5 shows a schematic cross section view of the short-wavelength electromagnetic-radiation generator 1 according to the third embodiment. The short-wavelength electromagnetic-radiation generator 1 according to the third embodiment includes, similarly to the first embodiment, a pair of concave reflectors M10 and M20 disposed approximately in parallel, a laser source 2 for emitting an electromagnetic radiation beam (laser beam L) having a predetermined wavelength so as to be incident between the concave reflectors M10 and M20, and an electron beam generator 3 for emitting an electron beam $e^-$ with respect to the laser beam L, which is repeatedly reflected between the concave reflectors M10 and M20. However, short-wavelength electromagnetic-radiation generator 1 according to the third embodiment is characterized in that the laser source 2 emits a pulse laser beam PL having a predetermined pulse width t, and the electron beam generator 3 emits the electron beam $e^-$, which is converged to have a beam diameter approximately equal to pulse width t of the pulse laser beam PL.

Concerning the pulse laser beam PL emitted from the laser source 2, for example, a Q-switched laser beam and a mode-locked laser beam may be used. By using the pulse laser beam PL of these types, the beam intensity can be increased to be much greater than that obtained when a CW laser beam is used, whereby scattered electromagnetic radiation can be generated at a high yield.

The diameter of the electron beam $e^-$ emitted from the electron beam generator 3 is adjusted in accordance with the diameter of the pulse laser beam PL converging in the approximate center of the distance between the concave reflectors M10 and M20.

In addition, in order that the electron beam $e^-$ whose diameter is adjusted may appropriately collide with the pulse laser beam PL converging between the concave reflectors M10 and M20 at a converging position where the pulse laser beam PL converges, the pulse width t of the pulse laser beam PL is adjusted to correspond to the diameter of the electron beam $e^-$.

It is more preferable that the diameter of the pulse laser beam PL in its converging position, and the diameter of the electron beam $e^-$ adjusted, be as small as possible. Practically, each diameter is approximately 50 Rm.

Accordingly, the pulse width t of the pulse laser beam PL which corresponds to the electron beam $e^-$ having a diameter of 50 $\mu$m is computed as follows:

$$\text{Beam diameter/Electromagnetic constant}=(50\times10^{-4})/(3\times10^{10})=1.7\times10^{-13}\ \text{(seconds)}.$$

In the above-described method, the electron beam $e^-$, whose diameter is adjusted, efficiently, securely collides with the pulse laser beam PL converging between the concave reflectors M10 and M20, whereby the inverse Compton effect is generated at an extremely high frequency in the scattering region S indicated by the double-dotted chain line shown in FIG. 5.

In other words, by emitting the pulse laser beam PL, which has a high intensity, between the concave reflectors M10 and M20, the pulse laser beam PL is repeatedly reflected and converged in the scattering region S, and its photon density is extremely increased. Accordingly, by emitting the electron beam e& whose diameter is adjusted to the scattering region S, the electron beam $e^-$ collides with the entire pulse laser beam PL in the scattering region S at high frequency, whereby the inverse Compton effect is generated at high frequency, which can generate scattered electromagnetic radiation at a high yield.

Figure 6:
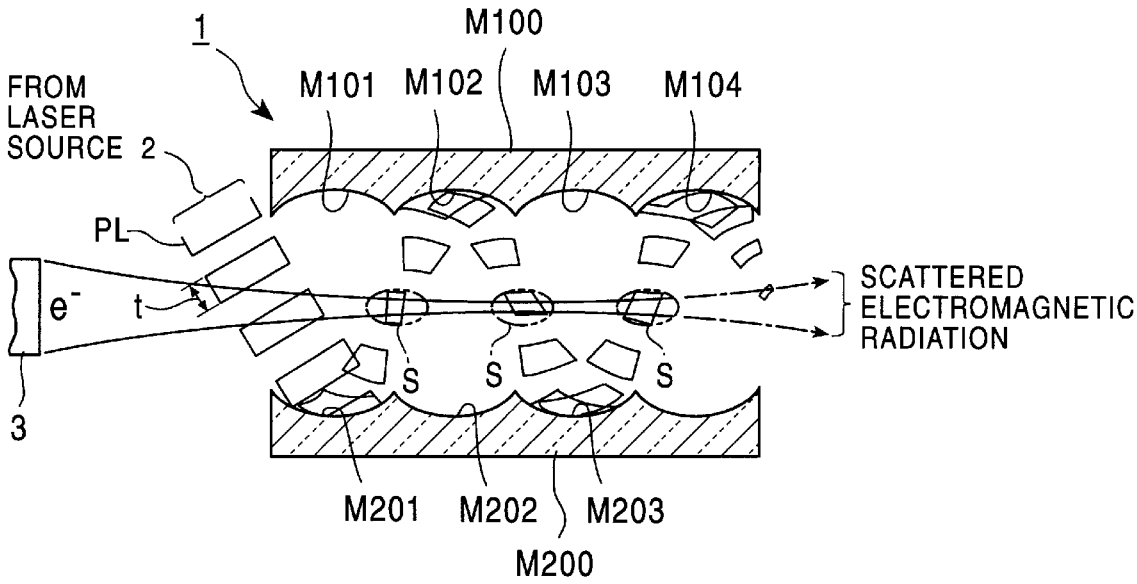
FIG. 6 is a schematic section view illustrating a short-wavelength electromagnetic-radiation generator according to a fourth embodiment of the present invention.

Next, a short-wavelength electromagnetic-radiation generator 1 according to a fourth embodiment of the present invention will be described below with reference to FIG. 6. FIG. 6 shows a schematic cross section view of the short-wavelength electromagnetic-radiation generator 1 according to the fourth embodiment. In FIG. 6, the shape of concave reflectors, the shape and path of a reflected beam, etc., indicate their concepts.

The short-wavelength electromagnetic-radiation generator 1 according to the fourth embodiment includes, similarly to the second embodiment, concave reflector groups M100 and M200 disposed to be opposed, a laser source 2 for emitting an electromagnetic radiation beam (laser beam L) having a predetermined wavelength so as to be incident between the concave reflector groups M100 and M200, and an electron beam generator 3 for emitting an electron beam with respect to the laser beam L, which is being repeatedly reflected between the concave reflector groups M100 and M200. However, the short-wavelength electromagnetic-radiation generator 1 according to the fourth embodiment is characterized in that the laser source 2 emits a pulse laser beam PL having a predetermined pulse width t, and the electron beam generator 3 emits the electron beam $e^-$, which is converged to have a beam diameter approximately equal to pulse width t of the pulse laser beam PL.

The concave reflector group M100 consists of a plurality of aligned concave reflectors M101 to M104. The concave reflector group M200 consists of a plurality of aligned concave reflectors M201 to M204. In other words, with the concave reflector groups M100 and M200 disposed to be opposed, the concave reflectors M101 to M104 are opposed to the concave reflectors M201 to M204, respectively.

For producing the opposed concave reflector groups M100 and M200, similarly to the second embodiment, for example, concave reflectors may simply be arranged in an array, or a monolithic arrangement may be used by forming, on a base member made of an insulator such as semiconductor or metal, a groove for the respective concave reflectors M101 to M104 and M201 to M204, and coating two sides of the groove with metal or the like.

In the fourth embodiment, the concave reflector group M100 consists of the four concave reflectors M101 to M104, and the concave reflector group M200 consists of the four concave reflectors M201 to M204. However, the number of concave reflectors constituting the concave reflector group M100 or M200 is not limited to four.

Concerning the pulse laser beam PL emitted from the laser source 2, for example, a Q-switched laser beam and a mode-locked laser beam may be used. By using the pulse laser beam PL of these types, the beam intensity can be increased to be much greater than that obtained when a CW laser beam is used, whereby scattered electromagnetic radiation can be generated at a high yield.

The diameter of the electron beam $e^-$ emitted from the electron beam generator 3 is adjusted in accordance with the diameter of the pulse laser beam PL converging in the approximate center of the distance between the concave reflectors M100 and M200.

In addition, in order that the electron beam $e^-$ whose diameter is adjusted may appropriately collide with the pulse laser beam PL converging between the concave reflectors M100 and M200 at a converging position where the pulse laser beam PL converges, pulse width t of the pulse laser beam PL is adjusted to correspond to the diameter of the electron beam $e^-$.

In order that scattered electromagnetic radiation may be generated by the short-wavelength electromagnetic-radiation generator 1, initially, the laser beam L is emitted from the laser source 2 so as to be incident between the concave reflector groups M100 and M200. The laser beam L is reflected and converged by the concave reflector M201 (or the M101) of one concave reflector group M200 (or M100), and is reflected by the concave reflector M102 (or M201) of the other concave reflector group M100 (or M200).

The laser beam L, reflected by the concave reflector M102 (or M202), is converged and reflected by the concave reflector M203 (or M103) of one concave reflector group M200 (or M100), and is reflected by the concave reflector M104 (or M204) of the other concave reflector group M100 (or M200).

In other words, the laser beam L, emitted from the laser source 2, is repeatedly reflected and converged zigzag between the concave reflector groups M100 and M200.

Next, the electron beam $e^-$ is emitted by the electron beam generator 3 between the concave reflector groups M100 and M200 so as to collide with the laser beam L, which is being repeatedly reflected and converged between the concave reflector groups M100 and M200. The diameter of the electron beam $e^-$ is equal to the diameter of the pulse laser beam PL converging between the concave reflectors M100 and M200. Thus, the electron beam e efficiently collides at extremely high frequency with the pulse laser beam PL being repeatedly reflected and converged.

In other words, because the pulse laser beam PL is repeatedly reflected and converged between the concave reflectors M100 and M200, its photon density increases greatly at the convergence region. By emitting to the convergence region the electron beam $e^-$ whose diameter is adjusted to be equal to the convergence diameter of the pulse laser beam PL, the inverse Compton effect is generated at extremely high frequency in the scattering region S indicated by the double-dotted line shown in FIG. 6.

As a result, in the scattering region S, the energy of the electron beam $e^-$ is supplied to the photons of the laser beam L, whereby scattered electromagnetic radiation that has a wavelength shorter than that of the laser beam L when it is incident between the concave reflectors M100 and M200 can be generated at a high yield.

Figure 7:
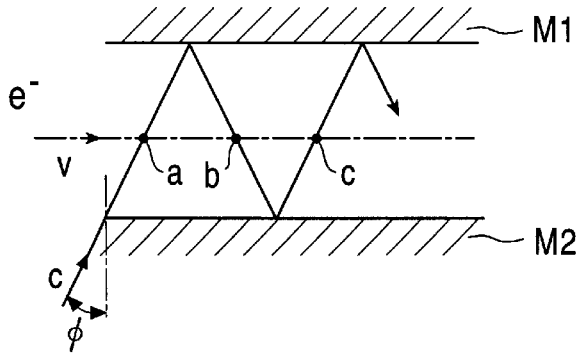
FIG. 7 is a drawing illustrating repetitive reflection.

Here, the photon yield of scattered electromagnetic radiation obtained when an electron beam is incident on a laser beam being repeatedly reflected and converged is described. FIG. 7 shows a conceptual drawing of the case where an electron beam $e^-$ is incident on a laser beam being repeatedly reflected and converged between mirrors M1 and M2.

When the laser beam is incident between the mirrors M1 and M2 at angle $\phi$, by setting velocity v of the electron beam $e^-$ at a value expressed by $v=C\cdot\sin\phi$(where C represents the electromagnetic constant), it is guaranteed that the electron beam $e^-$ always collides with photons of the laser beam at points a, b, and c (shown in FIG. 7) along the moving direction of the electron.

In the case where the electron beam $e^-$ and the laser beam each have the Gaussian distribution, and density $n_e$ of the electron beam $e^-$ and density $n_p$ of the laser beam are expressed by the following equations:

$$n_e \approx N_e \exp\{-\tfrac{1}{2}[(x^2/\sigma_{ex}^2)+(y^2/\sigma_{ey}^2)+(Z^2/\sigma_{ez}^2)]\},$$

and $$n_p \approx N_p \exp\{-\tfrac{1}{2}[(x^2/\sigma_{px}^2)+(y^2/\sigma_{py}^2)+(Z^2/\sigma_{pz}^2)]\}$$

where $N_e$ represents the number of photons in an electron beam, and $N_p$ represents the number of photons in a laser beam, Yield $N_x$ of high-energy photons, obtained when the electron beam $e^-$ collides with the laser beam at an angle of $\phi=\pi/2$ (rad), can be expressed by the following equation:

$$N_x \approx N_e N_p (\sigma_{py}^2+\sigma_{ey}^2)^{-1/2}\cdot(\sigma_{px}^2+\sigma_{ex}^2+\sigma_{pz}^2+\sigma_{ez}^2)^{-1/2}\cdot\sigma_{comp}$$

where $\sigma_{comp}$ represents the Klein-Nishina Compton cross section.

In other words, to increase yield $N_x$ of photons, $\sigma_{ex}$, $\sigma_{ey}$, $\sigma_{ez}$, and $\sigma_{pz}$, must be reduced by adjusting the electron beam $e^-$ and the laser beam, and also the extents $\sigma_{ex}$ and $\sigma_{px}$ of the laser beam in the respective travelling directions must be reduced.

Here, in the case where the laser beam is a Q-switched laser beam, and a pulse electron beam collides with the pulse laser beam at an angle of $\phi=\pi/2$ (rad), each beam must be spatially reduced in diameter while the pulse width of each beam is being compressed.

By way of example, the pulse width of a beam corresponding to a beam diameter of 50 $\mu$m is $(50\times10^{-4})/(3\times10^{10})\approx1.7\times10^{-13}$ (seconds)=170 (femtoseconds). Therefore, by adjusting the pulse widths of the pulse electron beam and the pulse laser beam to be approximately equal to the diameter of the converging beam, the yield of scattered electromagnetic radiation obtained by emitting the electron beam so as to collide with the repeatedly reflected laser beam can be increased to its maximum.

In addition, with the reflectance of the mirror (or concave reflector) represented by R, the continuous reflection of the laser beam by the mirror accumulates the luminous energy of the laser beam by 1+R+R2+. . . =1/(1−R) in the case where transmission loss can be ignored. Thus, when mirror reflectance R≈0.9999, the yield of photons is $10^4$ greater than that obtained when scattered electromagnetic radiation is generated without repeated reflection.

When an electron beam having $6\times10^{11}$ electrons is emitted to collide with a Q-switched YAG laser beam having a peak power of 1 J at 500 Hz, and each beam diameter is converged to 50 $\mu$m, obtained yield Y of photons, in head-on collision, is expressed by the following equation:

$$Y \approx (N_e N_p \sigma_{comp})/A = 2.4\times10^{10} \text{ photons/pulse} = 1.2\times10^{13} \text{ photons/second}$$

where A represents the area (in units of $cm^2$) of a larger cross section among the cross sections of an electron beam and a laser beam (In the case where A varies in the region where an electron beam and a laser beam collide, the maximum is used as A).

Because the sensitivity of a resist for X-ray lithography is 5 $mJ/cm^2$, the above-described yield Y of photons is in the vicinity of a limit enabling the exposure of the resist. Accordingly, as described above, by adjusting the pulse widths of the electron beam and the laser beam as to be approximately equal to the diameter of the converging beam, and emitting the electron beam to collide with the laser beam being repeatedly reflected so that the yield of photons is increased $10^4$ times, the yield of photons sufficient for resist exposure can be obtained.

In the foregoing embodiments, by appropriately setting the energy (acceleration voltage) of the electron beam $e^-$ emitted from the electron beam generator 3, the wavelength of the laser beam L emitted from the laser source 2, and the scattering angle of scattered electromagnetic radiation caused by collision with electrons, scattered electromagnetic radiation having the desired wavelength can be generated.

What is claimed is:

1. A short-wavelength electromagnetic-radiation generator comprising:

reflector means composed of at least a pair of concave reflectors;

emitting means for emitting electromagnetic radiation so as to be incident on said reflector means; and electron-beam generating means for emitting an electron beam, said electron beam being emitted in a direction substantially parallel to said reflector-means so as to be incident on said electromagnetic radiation.

2. A short-wavelength electromagnetic-radiation generator according to claim 1, wherein said reflector means comprises concave reflector groups disposed to be opposed, each concave reflector group being composed of a plurality of aligned concave reflectors.

3. A short-wavelength electromagnetic-radiation generator comprising:

reflector-means composed of at least a pair of concave reflectors;

electron-beam generating means for emitting an electron beam, said electron beam being emitted in a direction substantially parallel to said reflector-means and having a diameter adjusted to a diameter of electromagnetic radiation converged by said at least a pair of concave reflectors in said reflector means so that said electron beam is incident on a region where said electromagnetic radiation is converged by said pair of concave reflectors; and emitting means for emitting said electromagnetic radiation as a pulse beam having a pulse width corresponding to the diameter of said electron beam so as to be incident on said reflector means.

4. A short-wavelength electromagnetic-radiation generator according to claim 3, wherein said reflector means comprises concave reflector groups disposed to be opposed, each concave reflector group being composed of a plurality of aligned concave reflectors.

5. A short-wavelength electromagnetic-radiation generator according to claim 3, wherein said emitting means comprises a Q-switched laser source.

6. A short-wavelength electromagnetic-radiation generator according to claim 3, wherein said emitting means comprises a mode-locked laser source.

7. A short-wavelength electromagnetic-radiation generator according to claim 4, wherein said emitting means comprises a Q-switched laser source.

8. A short-wavelength electromagnetic-radiation generator according to claim 4, wherein said emitting means comprises a mode-locked laser source.

* * * * *